US011204008B2

(12) United States Patent
Pasquali et al.

(10) Patent No.: US 11,204,008 B2
(45) Date of Patent: Dec. 21, 2021

(54) FUEL INJECTION ASSEMBLY FOR AN INTERNAL COMBUSTION ENGINE

(71) Applicant: CPT Group GmbH, Hannover (DE)

(72) Inventors: Marco Pasquali, Leghorn (IT); Andrea Puccini, San Miniato (IT)

(73) Assignee: VITESCO TECHNOLOGIES GMBH, Hanover (DE)

( * ) Notice: Subject to any disclaimer, the term of this patent is extended or adjusted under 35 U.S.C. 154(b) by 454 days.

(21) Appl. No.: 16/336,646

(22) PCT Filed: Sep. 28, 2017

(86) PCT No.: PCT/EP2017/074660
§ 371 (c)(1),
(2) Date: Mar. 26, 2019

(87) PCT Pub. No.: WO2018/060348
PCT Pub. Date: Apr. 5, 2018

(65) Prior Publication Data

US 2021/0310453 A1 Oct. 7, 2021

(30) Foreign Application Priority Data

Sep. 29, 2016 (DE) ..... 16191368.6

(51) Int. Cl.
*F02M 61/14* (2006.01)
*F02M 61/16* (2006.01)

(52) U.S. Cl.
CPC ..... *F02M 61/14* (2013.01); *F02M 61/16* (2013.01); *F02M 61/168* (2013.01);
(Continued)

(58) Field of Classification Search
CPC ..... F02M 61/14; F02M 61/16; F02M 61/168; F02M 2200/853; F02M 2200/852;
(Continued)

(56) References Cited

U.S. PATENT DOCUMENTS 3,973,791 A * 8/1976 Porta ..... F16L 33/2073 285/305
4,431,218 A * 2/1984 Paul, Jr. ..... F16L 37/144 285/305

(Continued)

FOREIGN PATENT DOCUMENTS

CN 101806267 A 8/2010 ..... F02M 55/02
CN 104564470 A 4/2015 ..... F02M 61/14

(Continued)

OTHER PUBLICATIONS

Chinese Office Action, Application No. 201780060754.8, 5 pages, dated Jul. 2, 2020.

(Continued)

*Primary Examiner* — Sizo B Vilakazi
*Assistant Examiner* — Brian R Kirby
(74) *Attorney, Agent, or Firm* — Slayden Grubert Beard PLLC

(57) ABSTRACT

Various embodiments include a fuel injection assembly comprising: a fuel injector; an injector cup comprising a cylindrical body with a cavity at the lower end to receive a fuel inlet port of the injector; a holding element for securing the injector to the cup; a spring clip; and a first opening formed in a peripheral wall of the cup for receiving the holding element. The holding element comprises a U-shaped body with two parallel arms engaging opposite sides of an annular groove in the injector to secure the injector in the cup. When inserted in the cup, the free ends of the two arms project from the cup, and include adjacent the free ends a retention arrangement engageable by the spring clip. The spring clip comprises a depending leg engageable in a corresponding receiving part on the injector to locate the angular position of the injector relative to the cup.

11 Claims, 4 Drawing Sheets

(52) U.S. Cl.
CPC . *F02M 2200/852* (2013.01); *F02M 2200/853* (2013.01); *F02M 2200/856* (2013.01)

(58) Field of Classification Search
CPC . F02M 2200/856; F02M 55/04; F16L 37/144; F16L 37/1225
USPC ..... 123/456, 470; 285/331
See application file for complete search history.

(56) References Cited

U.S. PATENT DOCUMENTS 5,058,554 A * 10/1991 Takeda ..... F16B 21/186 123/456
5,520,151 A * 5/1996 Gras ..... F02M 41/14 123/469
5,683,117 A * 11/1997 Corbett ..... F16L 37/0885 285/24
5,901,688 A * 5/1999 Balsdon ..... F02M 25/0836 123/516
5,970,953 A * 10/1999 Lorraine ..... F02M 61/14 123/470
6,334,242 B1 * 1/2002 Scollard ..... F02M 35/10144 24/459
7,360,524 B2 * 4/2008 Zdroik ..... F02M 55/005 123/469
7,527,038 B2 * 5/2009 Watanabe ..... F02M 55/02 123/470
7,556,022 B1 * 7/2009 Doherty ..... F02M 55/004 123/456
7,571,939 B2 * 8/2009 Yoshida ..... F16L 37/144 285/321
7,823,930 B2 * 11/2010 Feger ..... F16L 37/144 285/319
8,408,184 B2 * 4/2013 Marc ..... F02M 61/14 123/470
8,479,710 B2 7/2013 Davis ..... 123/470
8,646,434 B2 * 2/2014 Harvey ..... F02M 61/14 123/470
8,813,722 B2 * 8/2014 Harvey ..... F02M 69/465 123/470
9,567,961 B2 * 2/2017 Cass ..... F02M 61/14
9,816,657 B2 * 11/2017 Daimon ..... F16L 37/12
9,938,948 B2 * 4/2018 Serra ..... F02M 61/145
9,957,938 B2 * 5/2018 Roseborsky ..... F02M 63/0275
10,047,712 B2 * 8/2018 Di Domizio ..... F02M 61/14
10,422,459 B2 * 9/2019 Jones ..... F16L 37/12
10,487,786 B2 * 11/2019 Carli ..... F02M 61/14
10,844,818 B2 * 11/2020 Pasquali ..... F02M 61/168
2002/0100456 A1 * 8/2002 Panasuk ..... F02M 69/465 123/456
2004/0051313 A1 * 3/2004 Trouyet ..... F16L 37/0885 285/305
2010/0031927 A1 * 2/2010 Notaro ..... F02M 55/025 123/470
2010/0300406 A1 12/2010 Harvey et al. ..... 123/456
2013/0074951 A1 * 3/2013 Marc ..... F02M 61/168 137/343
2015/0013643 A1 * 1/2015 Serra ..... F02M 61/168 123/470
2015/0330347 A1 * 11/2015 Pohlmann ..... F02M 61/168 239/408
2016/0025053 A1 * 1/2016 Reinhardt ..... F02M 63/0012 239/584
2016/0333836 A1 * 11/2016 Lang ..... F02M 55/005
2017/0342952 A1 * 11/2017 Pasquali ..... F02M 61/168

FOREIGN PATENT DOCUMENTS

CN 105658949 A 6/2016 ..... F02M 61/14
EP 1892408 A1 * 2/2008 ..... F02M 61/14
EP 2896817 A1 * 11/2014
EP 3 070 323 A1 9/2016 ..... F02M 61/16
JP 2007224914 A 9/2007 ..... F02M 39/00
WO WO-2009039021 A1 * 3/2009 ..... F02M 55/005
WO 2015/135732 A1 9/2015 ..... F02M 51/00
WO 2018/060348 A1 4/2018 ..... F02M 61/14

OTHER PUBLICATIONS

Extended European Search Report, Application No. 16191368.6, 6 pages, dated Feb. 2, 2017.
International Search Report and Written Opinion, Application No. PCT/EP2017/074660, 11 pages, dated Jan. 12, 2018.
Korean Notice of Allowance, Application No. 2020066582342, 3 pages, dated Sep. 25, 2020.

* cited by examiner

FUEL INJECTION ASSEMBLY FOR AN INTERNAL COMBUSTION ENGINE

CROSS-REFERENCE TO RELATED APPLICATIONS

This application is a U.S. National Stage Application of International Application No. PCT/EP2017/074660 filed Sep. 28, 2017, which designates the United States of America, and claims priority to EP Application No. 16191368.6 filed Sep. 29, 2016, the contents of which are hereby incorporated by reference in their entirety.

TECHNICAL FIELD

The present disclosure relates to internal combustion engines. Various embodiments may include fuel injection assemblies for an internal combustion engine, particularly but not exclusively, for a gasoline direct injection internal combustion engine.

BACKGROUND

Fuel injection assemblies are widely used for injecting fuel into an internal combustion engine, particularly having an injector for each cylinder of a multi-cylinder engine in which the fuel is supplied from a reservoir in the form of a common rail to which each of the injectors is connected. In known systems the injectors are secured directly to the cylinder head of the engine to project into the combustion chamber. Such arrangements generate noise by the injection and combustion process and the noise is transmitted through the engine to the exterior. In order to reduce noise transmission one known solution is to isolate the injector from direct mechanical connection with the engine. One solution to this problem is to suspend the injector in a fuel rail injector cup which is itself secured to the fuel rail and the engine. In this way there is no direct mechanical coupling between the injector and the engine components.

A further problem arises in that it possible for the fuel injector to pivot about the axis of the injector cup during assembly. It is necessary for the fuel injector to be precisely positioned angularly relative to the injector cup so that the fuel injector fuel output is in the correct position for fuel injection into the combustion chamber. In the known arrangements this is achieved by means of a further component known as an indexing clip. Such arrangements are shown for example in U.S. Pat. No. 8,479,710 and WO 2015/135732.

SUMMARY

The teachings present disclosure describe various fuel injection assemblies with fewer components than the known arrangement and/or which is easier and quicker to assemble, particularly in securing the fuel injector in the injector cup. For example, some embodiments include a fuel injection assembly having a longitudinal axis (L) and comprising: an elongate fuel injector (2) having a fuel inlet port and a fuel outlet port, an injector cup (4), a holding element (12) for securing the fuel injector (2) to the injector cup (4), and a spring clip (18). The injector cup (4) comprises a generally cylindrical body extending along the axis L and having an upper and a lower end, the cup (4) having a cavity at its lower end adapted to receive a fuel inlet port of the fuel injector (2), a first opening or openings are formed in the peripheral wall of the injector cup for receiving the holding element (12), the holding element (12) is generally U-shaped having two generally parallel arms (14) shaped and positioned to engage opposite lateral sides of an annular groove in the fuel injector (2) to secure the fuel injector (2) in the injector cup (4), when inserted in the injector cup (4), the free ends of the two arms (14) of the holding element (12) project from the injector cup (4), and have adjacent the free ends a retention arrangement (16) engageable by the spring clip (18), the spring clip (18) has at least one depending leg (32) engageable in a corresponding receiving part (10) on the fuel injector (2) to accurately locate the angular position the fuel injector (2) relative to the injector cup (4).

In some embodiments, the retention arrangement (18) on the holding element comprises inwardly directed detents (16) adjacent to the ends of the two arms (14) of the holding element (12), the spring clip (18) having a spring element (28) engageable in the inwardly directed detents (16).

In some embodiments, the spring clip (18) comprises a one-piece body incorporating the spring element (28) and is securable to the injector cup.

In some embodiments, the spring clip (18) is securable to the injector cup (2) by brazing or welding and has at least one locating section (22) having therein at least one inspection opening (26) to enable the quality of the brazing/welding of the clip 18 to the injector cup 2 to be inspected.

In some embodiments, the spring clip (18) includes two locating sections (22, 24) spaced in the longitudinal axial direction and each locating section has two inspection openings (26).

In some embodiments, the locating sections (22, 24) are curved, having a radius of curvature to match that of the exterior wall of the injector cup (4).

In some embodiments, the spring clip (18) has two depending legs (32) in spaced parallel relationship, the legs (32) engaging on either side of an indexing tab (33) on the fuel injector body thereby to accurately locate the angular position of the fuel injector (2) relative to the injector cup (4).

In some embodiments, each leg is engageable in a corresponding receiving part (10) on the fuel injector (2), the receiving part or parts (10) comprise recesses in the fuel injector (2).

In some embodiments, the recesses are formed in a plastics component part of the fuel injector (2).

In some embodiments, the spring element (18) is formed by opposing cantilevered leaf sections (30) having an arcuate profile.

As another example, some embodiments include a fuel injection assembly as described above, wherein the spring element is formed by opposing cantilevered leaf sections (34) which are substantially straight.

BRIEF DESCRIPTION OF THE DRAWINGS

Example embodiments of the fuel injection assembly are described by way of example with reference to the accompanying drawings in which.

DETAILED DESCRIPTION

Figure 1:
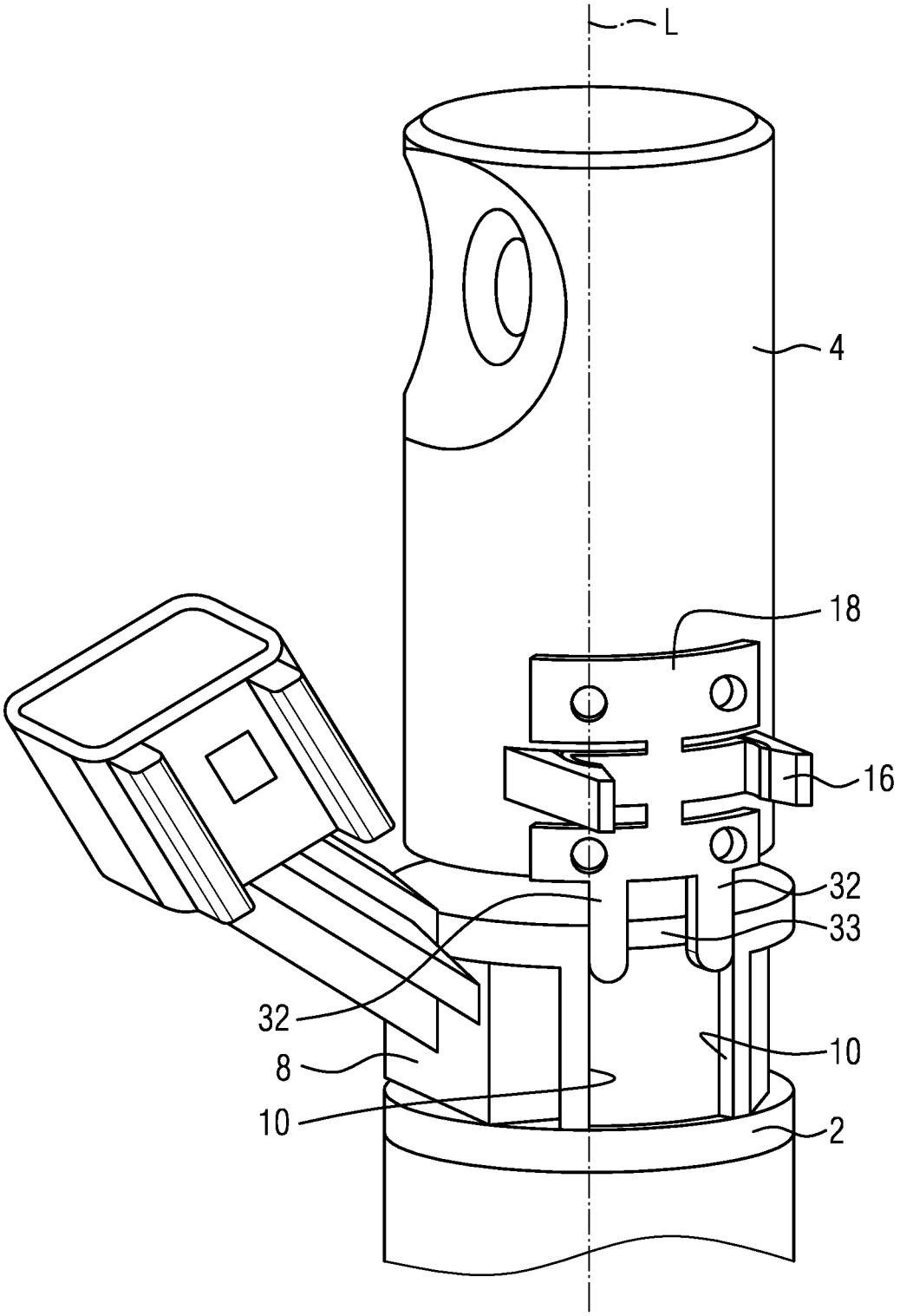
FIG. 1 shows a perspective view of a fuel injection assembly incorporating teachings of the present disclosure.
Figure 2:
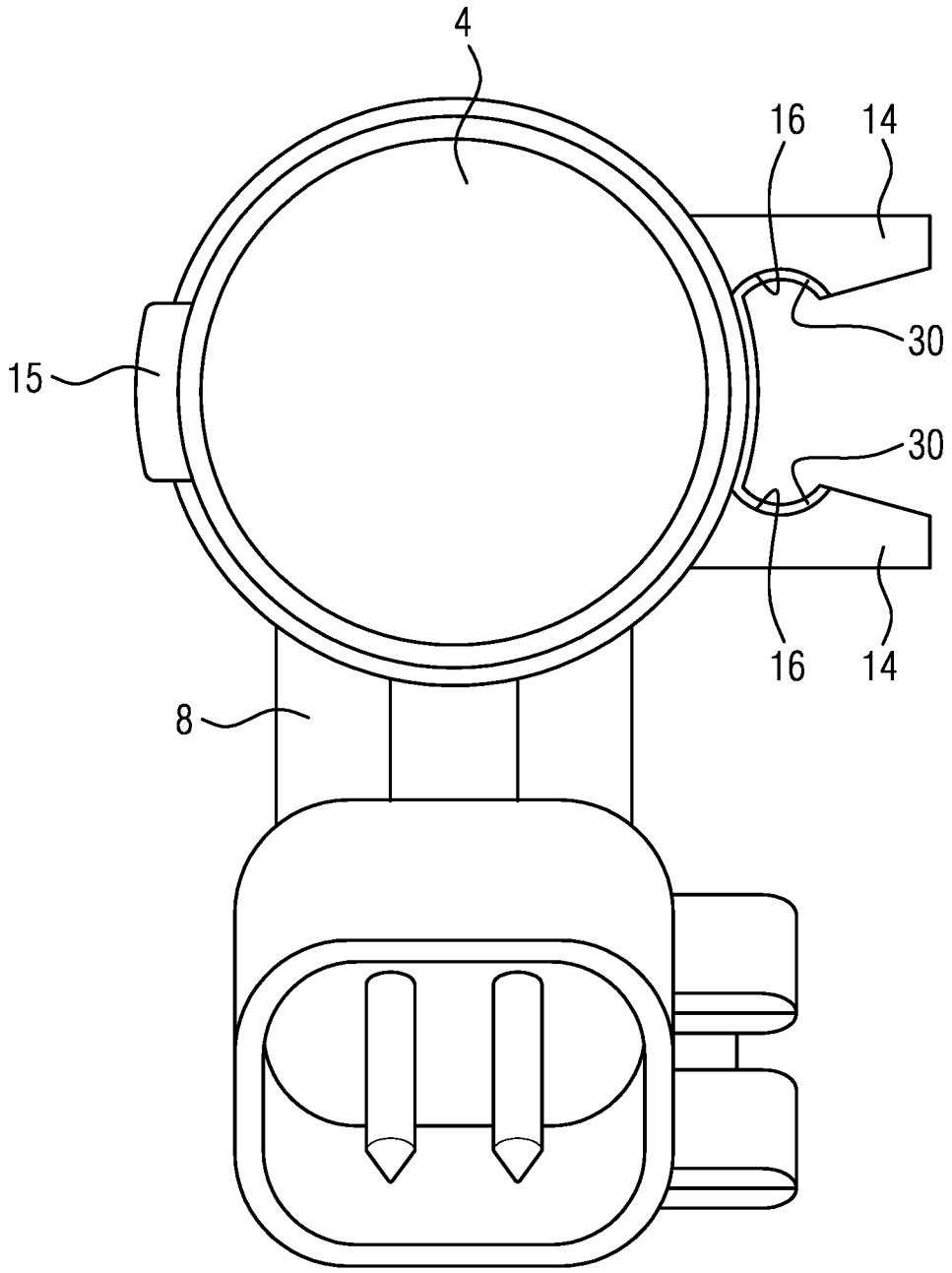
FIG. 2 shows a plan view of the fuel injection assembly incorporating teachings of the present disclosure.

Various embodiments of the teachings of the present disclosure include a fuel injection assembly having a longitudinal axis. The assembly may comprise an elongate fuel injector having a fuel inlet port and a fuel outlet port, an injector cup, a holding element for securing the fuel injector to the injector cup, and a spring clip.

In some embodiments, the injector cup comprises a generally cylindrical body extending along the axis and having an upper and a lower end. It has a cavity at its lower end adapted to receive a fuel inlet port of the fuel injector, a first opening or openings being formed in the peripheral wall of the injector cup for receiving the holding element. The cavity is in particular shaped by the peripheral wall. In an assembled state, the fuel inlet port may expediently be received in the cavity and the holding element is received in the first opening or openings.

In some embodiments, the holding element is generally U-shaped having two parallel or at least generally parallel arms. More specifically, each arm has a free end and the arms are connected at their ends opposite the free ends by a web of the holding element to form the U-shape. The arms are shaped and positioned to engage opposite sides—e.g. in particular opposite lateral sides—of an annular groove in the fuel injector to secure the fuel injector in the injector cup. In case of the assembled fuel injection assembly, the arms engage opposite sides of the annular groove. In some embodiments, the arms are shaped and positioned so as to laterally embrace the fuel injector.

In some embodiments, the fuel injector has two separate grooves on opposite sides which the arms engage, without the groove extending completely circumferentially around the fuel injector. Such an embodiment shall also be covered by the expression "opposite sides of an annular groove" in the present context.

In the present context, that the arms engage opposite sides of the lateral groove is in particular understood to mean that one arm engages a first contact region of the groove and the other arm engages a second contact region of the groove, wherein the first and second contact regions are arranged in different half-spaces which are defined by a plane comprising the longitudinal axis and being parallel to a main extension direction of the arms. In other words, the plane comprises the longitudinal axis and is perpendicular to a distance vector between the arms or the first and second contact regions, respectively. Preferably, the first and second contact regions do not overlap.

In some embodiments, the arms and the web are in particular integrally formed, i.e. the holding element is in particular a one-pieced part. The expression "one-pieced" means in the present context that the holding element is not assembled from a plurality of parts which are connected to one another during the manufacturing process of the holding element. Rather, the holding element is a single workpiece or made from a single workpiece. In particular, the holding element is a metal bracket.

In some embodiments, the holding element is shaped and arranged such that, when inserted in the injector cup, the free ends of the two arms of the holding element project from the injector cup, and have—adjacent the free ends—a retention arrangement engageable by the spring clip. In case of the assembled fuel injection assembly, the spring clip expediently engages the retention arrangement.

In some embodiments, the spring clip has at least one depending leg engageable in a corresponding receiving part on the fuel injector to accurately locate the angular position the fuel injector relative to the injector cup. In case of the assembled fuel injection assembly, the depending leg expediently engages in the receiving part on the fuel injector.

Embodiments incorporating teachings of this disclosure have the advantage of a low-cost solution to the known problems both in the cost of the individual components and in production assembly. Essentially connecting and indexing of the injector relative to the cup is achieved by means of two elements which are easy and economical to produce, namely the holding element, which consists of a—preferably flat—U-shaped element, and a spring clip which can be produced as a simple pressing from a sheet metal material which can be welded or brazed to the injector cup, or as a plastics moulding. Assembly of the fuel injector and injector cup is a simple two step operation; the injector is inserted in the injector cup, and the holding element is pushed into place to locate the injector in the injector cup.

In some embodiments, the spring clip is secured, e.g. welded and/or brazed, to the injector cup, in particular subsequent to accurately locating the spring clip on the injector cup. The spring clip may be secured to an external surface of the peripheral wall of the injector cup. In this way, production of the assembly may be particularly cost-efficient.

In some embodiments, the spring clip comprises a spring element which engages the retention arrangement. The spring element is in particular laterally compliant so that it is in particular operable to be laterally deflected when the holding element is inserted into the injector cup and to snap back into engagement with the retention arrangement when the holding element has reached its final position.

In some embodiments, the spring clip comprises a one-piece body incorporating the spring element, the depending leg, and a locating section having therein at least one inspection opening to enable the quality of the brazing/welding of the clip to the injector cup to be inspected. The locating section may adjoin the injector cup or—in case of a brazed connection—at least the brazing material by means of which it is fixed to the injector cup; in particular it is in full-area contact with the injector cup and/or the brazing material. The spring element may project away from the injector cup in radially outward direction. The depending leg may project axially beyond the injector cup in direction towards the fuel outlet port of the fuel injector. In this way, the spring clip is at the same time multifunctional and particularly cost effective. The risk of failure of the fuel assembly during operation may be particularly small.

In some embodiments, the retention arrangement on the holding element comprises inwardly directed detents adjacent to the free ends of the two arms of the holding element, the spring element being engageable—and engaged in the assembled state of the assembly—in the inwardly directed detents. In the present context, "inwardly directed" means in particular that the detents face towards each other. In radial direction, the detents are preferably positioned between the injector cup and the free ends of the arms in the assembled state of the fuel injection assembly. With advantage, a secure releasable connection of the holding element to the injector cup by means of the spring clip may be easily established in this way.

In some embodiments, the spring clip includes two locating sections spaced in the longitudinal axial direction and each locating section may have two inspection openings. In some embodiments, the locating sections are curved, having a radius of curvature to match that of the injector cup, in particular the curvature of the external surface of the peripheral wall.

In some embodiments, the spring clip has two depending legs in spaced parallel relationship, each leg being engageable in a corresponding receiving part on the fuel injector. In the assembled state of the fuel injection assembly, each leg engages the respective receiving part. In some embodiments, the receiving parts comprise recesses in the fuel injector. In some embodiments, the recesses are formed in a plastics component part of the fuel injector. In this way, the recesses can be pre-formed in a mould from which the plastics component is manufactured. The recesses may extend from an aperture through which the respective leg is inserted into the recess in longitudinal direction towards the fuel outlet port.

In some embodiments, the spring element is formed by opposing cantilevered sections having an arcuate profile, whilst in another embodiment, the cantilevered sections are substantially straight.

In the exemplary embodiments and figures, identical, similar or similarly acting constituent parts are provided with the same reference symbols. In some figures, individual reference symbols may be omitted to improve the clarity of the figures. Referring now to the drawings, FIG. 1 illustrates a fuel injection assembly according to a first exemplary embodiment incorporating teachings of the present disclosure shown in a perspective view. The fuel injection assembly comprises a fuel injector cup 4 and a fuel injector 2 (only partly shown in FIG. 1) secured to the injector cup 4. The injector cup 4 consists of an elongate generally cylindrical body extending along a longitudinal axis L.

A circumferential peripheral wall of the injector cup 4 has a recess 6 at its external side and adjacent its upper end. The injector cup 4 is rigidly secured and hydraulically connected to a common rail (not shown) of the fuel injection assembly through said recess 6. In other embodiments, the cup may be secured to the fuel supply by a connector on its top surface, for example via a drop pipe.

The fuel injector 2 comprises—rigidly connected to a valve body—an electrical connection block 8 which is formed of a moulded plastics material and has moulded therein two elongate grooves or recesses 10 extending in the direction of the longitudinal axis L. The recesses 10 extend from an aperture in axial direction towards a fuel outlet port of the fuel injector 2. A spring clip 18, referred to as an indexing clip, serves to locate the fuel injector 2 in the correct angular position relative to the injector cup 4 as described hereinafter.

Figure 3:
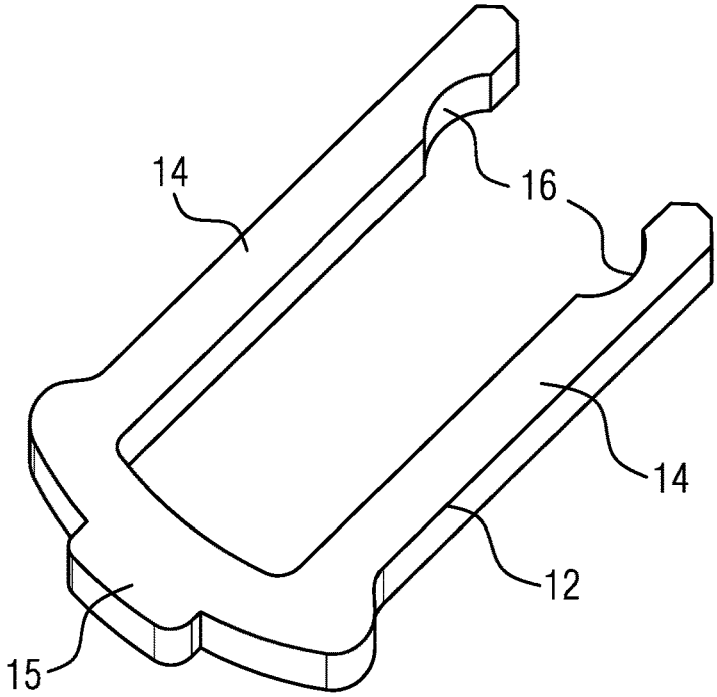
FIG. 3 shows a perspective view of a holding element incorporating teachings of the present disclosure.

The fuel injector 2 is inserted in the lower end of the injector cup 4 so that a fuel inlet port of the injector 2 (not visible in the figures) is positioned inside the injector cup 4. The fuel injector 2 is secured in the injector cup 4 by a holding element 12 illustrated in FIG. 3. The holding element 12 consists of a one-pieced, U-shaped metal bracket having two generally parallel arms 14 extending from a web 15. The web 15 has shoulders 13 which, in the installed position abut the edges of an opening in the form of a slot 17 in the peripheral wall of the injector cup 4. The two arms 14 each have, at their free ends remote from the web 15, an inwardly facing detent 16 to thus provide two facing detents.

Figure 5A:
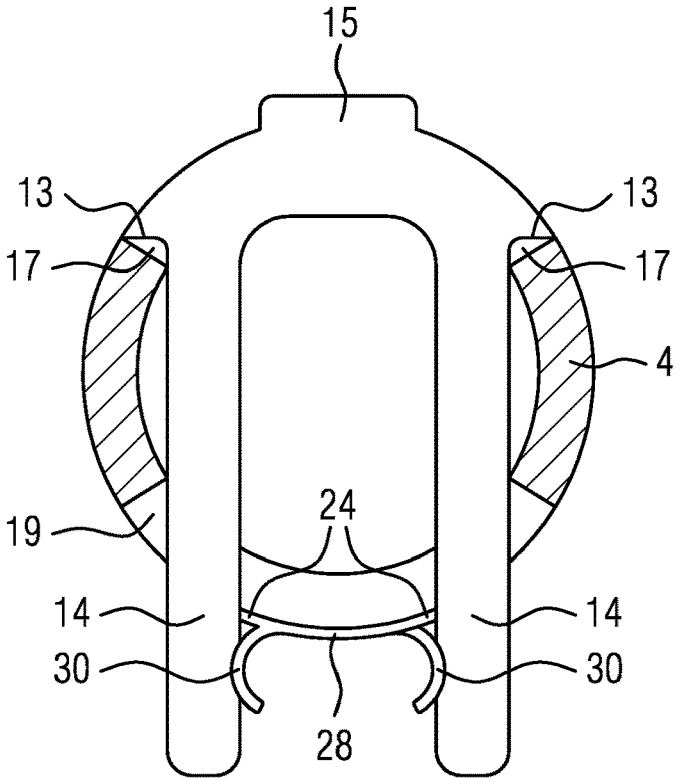
FIG. 5A shows a sectional plan view of the fuel injection assembly incorporating teachings of the present disclosure.
Figure 5B:
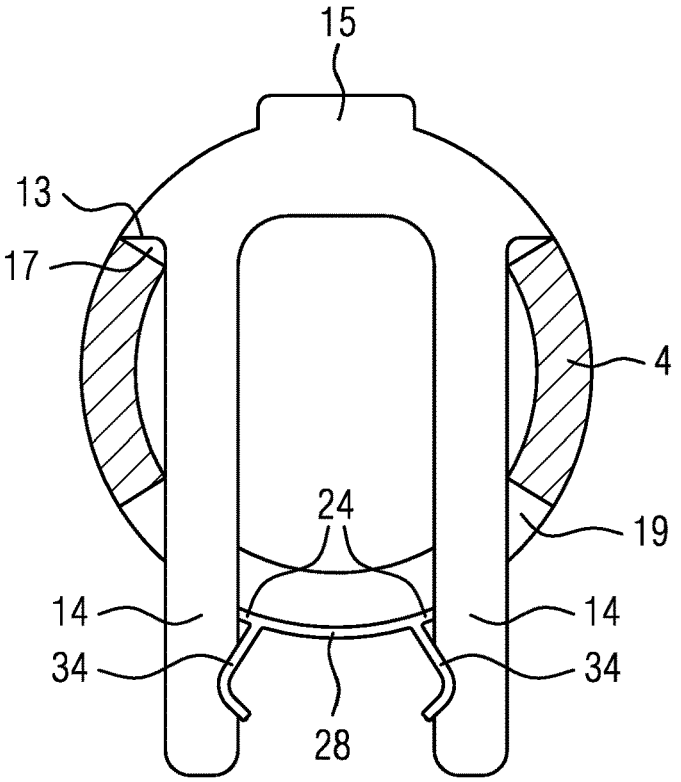
FIG. 5B shows a sectional plan view of a fuel injection assembly incorporating teachings of the present disclosure.

To assemble the fuel injector 2 to the injector cup 4, the inlet port of the fuel injector is inserted in a cavity of the injector cup 4 through an opening in the bottom of the injector cup 4. The cavity and the opening are shaped by the circumferential exterior wall. The arms 14 of the holding element 12 are pushed through the slot 17 in the peripheral wall of the injector cup until the shoulders 13 abut the edges of the slot 17 as shown in FIGS. 5A and 5B The free ends of the arms 14 project through a further slot 19 in the peripheral wall so that their inwardly facing detents 16 project laterally beyond the wall of the injector cup 4. In this assembled position, the arms 14 of the holding element engage on respective opposite sides of a groove on the fuel injector and thus locate the fuel injector 2 in the axial direction of the injector cup 4. In some embodiments, the peripheral wall of the injector cup 4 has two through holes instead of the slot 17 and/or two further through holes instead of the further slot 19, each through-hole configured for receiving one of the arms 14.

Since the groove by which the holding element 12 engages the fuel injector 2 extends around the fuel injector 2, it is possible for the fuel injector to rotate about the longitudinal axis L relative to the injector cup 4. This is undesirable because it is necessary for the fuel injector 2 to be at the correct angular displacement when it enters the combustion chamber of the engine to ensure that the desired characteristics and direction of the fuel being injected are realised. In this disclosure the angular position of the fuel injector 2 relative to the injector cup 4 is determined by and maintained by the spring clip 18 as illustrated in FIG. 4.

Figure 4:
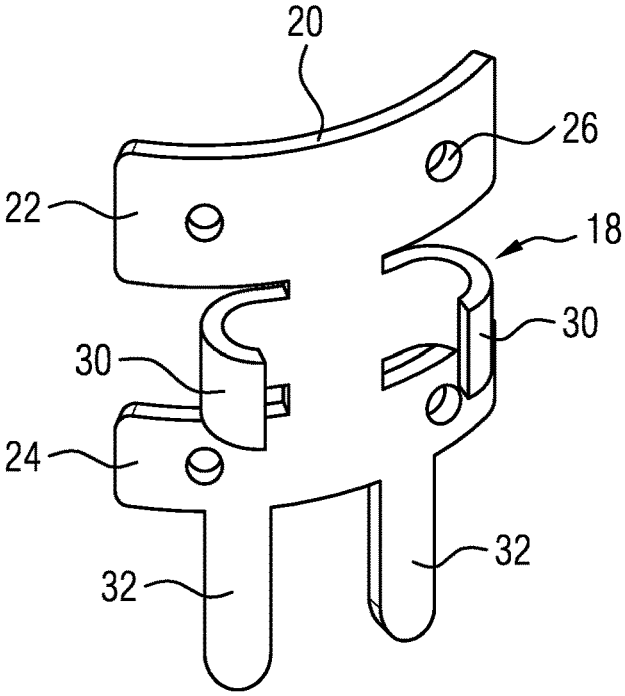
FIG. 4 shows a perspective view of a spring clip incorporating teachings of the present disclosure.

Referring now to FIG. 4, there is shown a spring clip 18 formed from a one-piece body which may be formed of a moulded plastics material or a pressed metal but in this embodiment is formed of metal. The clip 18 has one face 20 which has an arcuate form with a radius which is substantially identical to that of the exterior wall of the injector cup 4. The spring clip 18 is welded or brazed to the injector cup 2. Other methods of securely bonding the spring clip to the injector cup such as adhesives may be used.

In some embodiments, spring clip 18 has two spaced locating sections 22 and 24 each of which has two inspection openings 26 which comprise inspection points to enable the quality of the brazing/welding of the clip 18 to the injector cup 2 to be inspected. The two locating section 22, 24 are positioned on opposite axial sides of the further slot so that the spring clip 18 partially covers the further slot 19, leaving portions of the further slot 19 uncovered in either circumferential direction, the arms 14 extending through the uncovered portions.

Between the two locating sections 22 and 24 the clip 18 includes a spring element 28 which consists of two opposed curved cantilever spring leaves 30 which engage in the detents 16 in the arms 14 of the holding element 12 to securely lock the holding element in the injector cup 2, as illustrated in FIG. 5A. The spring clip 18 has two parallel depending legs 32 which extend parallel to the longitudinal axis L and engage in the grooves or recesses 10 in the fuel injector body 8. When the injector cup is being offered up, an indexing tab 33 on the fuel injection body 8 is located between and is engaged by the legs 32. In this way, the angular position of the fuel injector 2 relative to the injector cup 4 is accurately located by the tab 33 in the desired angular position relative to the injector cup 4.

Assembly of the fuel injector to the injector cup is achieved very quickly in two steps. The fuel injector is inserted in the injector cup and the holding element in then inserted in a push fit until the web shoulders 13 abut the cup wall, in which position the detents 16 are engaged by the spring clip 18. In the same step, any necessary angular movement of the fuel injector is made.

FIG. 5B illustrates an alternative form of the spring element 28 with straight spring leaves, reference 34. This gives an alternative characteristic to the spring to give a desired spring rate. In some embodiments, the depending legs 34 are strengthened by increasing their cross-sectional area typically by including a web or raised section along the face away from the recesses 10, the web or raised section preferably being thicker or more pronounced towards the root or base of the legs adjacent the lower locating section 24.

In some embodiments, the cup 2 has two openings which replace the slot 17 and the arms 14 are a push fit through these openings until the web 15 abuts the outside of the injector cup.

What is claimed is:

1. A fuel injection assembly having a longitudinal axis, the assembly comprising:

an elongate fuel injector having a fuel inlet port and a fuel outlet port;

an injector cup comprising a generally cylindrical body extending along the axis with an upper end and a lower end, and a cavity at the lower end adapted to receive a fuel inlet port of the fuel injector;

a holding element for securing the fuel injector to the injector cup;

a spring clip;

a first opening formed in a peripheral wall of the injector cup for receiving the holding element;

wherein the holding element comprises a generally U-shaped body with two generally parallel arms shaped and positioned to engage opposite lateral sides of an annular groove in the fuel injector to secure the fuel injector in the injector cup, when inserted in the injector cup, the free ends of the two arms project from the injector cup, and include adjacent the free ends a retention arrangement engageable by the spring clip;

the spring clip comprises a depending leg engageable in a corresponding receiving part on the fuel injector to locate the angular position the fuel injector relative to the injector cup.

2. A fuel injection assembly according to claim 1, wherein:

the retention arrangement comprises inwardly directed detents adjacent to the ends of the two arms; and the spring clip comprises a spring element engageable in the inwardly directed detents.

3. A fuel injection assembly according to claim 2, wherein the spring clip comprises a one-piece body incorporating the spring element securable to the injector cup.

4. A fuel injection assembly according to claim 3, wherein the spring clip is securable to the injector cup by brazing or welding and has a locating section with an inspection opening to inspect the quality of the brazing/welding of the clip to the injector cup.

5. A fuel injection assembly according to claim 4, wherein the spring clip includes two locating sections spaced in the longitudinal axial direction and each locating section has two inspection openings.

6. A fuel injection assembly according to claim 3, wherein the locating sections are curved with a radius of curvature to match that of the exterior wall of the injector cup.

7. A fuel injection assembly according to claim 1, wherein the spring clip has two depending legs spaced parallel from one another relationship, the legs engaging on either side of an indexing tab on the fuel injector body to locate the angular position of the fuel injector relative to the injector cup.

8. A fuel injection assembly according to claim 1, wherein:

each leg is engageable in a corresponding receiving part on the fuel injector; and the receiving part or parts comprise recesses in the fuel injector.

9. A fuel injection assembly according to claim 8, wherein the recesses are formed in a plastics component part of the fuel injector.

10. A fuel injection assembly according to claim 1, wherein the spring element comprises opposing cantilevered leaf sections having an arcuate profile.

11. A fuel injection assembly according to claim 1, wherein the spring element comprises opposing cantilevered leaf sections which are substantially straight.

* * * * *